US005662310A

United States Patent [19]

Carson, Sr.

[11] Patent Number: 5,662,310

[45] Date of Patent: Sep. 2, 1997

[54] STUD ADJUSTER APPARATUS

[76] Inventor: Steven L. Carson, Sr., 6208 Twilight Tr., Morrow, Ga. 30260

[21] Appl. No.: 577,691

[22] Filed: Dec. 22, 1995

[51] Int. Cl.[6] ..... B66D 1/00

[52] U.S. Cl. ..... 254/218; 52/514; 52/291; 254/221

[58] Field of Search ..... 254/218, 221; 256/37, 40; 226/76, 82; 52/291, 514, 223.1, 223.6

[56] References Cited

U.S. PATENT DOCUMENTS

| | | | |
|---|---|---|---|
| 381,569 | 4/1888 | McMahon | 254/218 |
| 2,856,644 | 10/1958 | Dunham | 52/291 |
| 2,856,646 | 10/1958 | Latimer et al. | 52/223.6 |
| 3,066,548 | 12/1962 | Shapiro | 226/76 |
| 4,038,803 | 8/1977 | Schoeller | 52/291 |
| 4,367,993 | 1/1983 | Meigs | 254/221 |
| 4,575,980 | 3/1986 | Shuler | 52/291 |

*Primary Examiner*—Katherine Matecki

[57] ABSTRACT

A star stud adjuster apparatus including an adjuster. The adjuster includes a J-shaped support with an exterior surface having a pair of brackets projecting therefrom. The adjuster includes a handle with a forked end that is capable of being positioned between the brackets. Also provided is a cylindrical member. The cylindrical member has a pair of side surfaces with each having a ratchet integral thereto and projecting therefrom. The cylindrical member is positionable between the forked ends and held in place with an axial rod. Banding material is included. The banding material is weaved around a plurality of bowed studs and is secured by a nail to one of the bowed studs. The banding material is capable of being positioned around the cylindrical member between the forked end when the adjuster is positioned on an opposite stud.

7 Claims, 3 Drawing Sheets

STUD ADJUSTER APPARATUS

BACKGROUND OP THE INVENTION

1. Field of the Invention

The present invention relates to a star stud adjuster apparatus and more particularly pertains to straightening bowed studs and using the apparatus to make them flush.

2. Description of the Prior Art

The use of a stud positioning device is known in the prior art. More specifically, stud positioning devices heretofore devised and utilized for the purpose of stud placement are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 4,843,726 to Ward discloses a stud alignment and positioning tool comprising a plurality of rigid jaws securable to a series of wall studs. U.S. Pat. No. 4,870,742 to Hansmann discloses a wall racking tool utilizing a clamp for securement to a sill plate and a series of ropes and pulleys. Lastly, U.S. Pat. No. 3,779,515 to Larios et al. discloses a an adjustable decking and framing tool comprising a horizontal base bar pivotally connected at one end with a vertical lever arm and a plurality of attachments connected to the other end of the base bar.

While these devices fulfill their respective, particular objectives and requirements, the aforementioned patents do not describe a star stud adjuster apparatus that allows straightening of bowed studs when the banding material is secured to one stud then wrapped around the bowed stud and threaded through the adjuster for pulling of the banding material to straighten the stud.

In this respect, the stud adjuster apparatus according to the present invention substantially departs from the conventional concepts and designs of the prior art, and in doing so provides an apparatus primarily developed for the purpose of straightening bowed studs and using the apparatus to make them flush.

Therefore, it can be appreciated that there exists a continuing need for a new and improved star stud adjuster apparatus which can be used for straightening bowed studs and using the apparatus to make them flush. In this regard, the present invention substantially fulfills this need.

SUMMARY OF THE INVENTION

In view of the foregoing disadvantages inherent in the known types of stud positioning devices now present in the prior art, the present invention provides an improved star stud adjuster apparatus. As such, the general purpose of the present invention, which will be described subsequently in greater detail, is to provide a new and improved star stud adjuster apparatus and method which has all the advantages of the prior art and none of the disadvantages.

To attain this, the present invention essentially comprises an adjuster. The adjuster includes a J-shaped support and a handle with a forked end. The J-shaped support has a long arm, a short arm and an arm connector therebetween. The long arm has an exterior surface with a pair of brackets projecting therefrom. The brackets are capable of coupling with the forked end of the handle. The support is further capable of being positioned around a generally rectangular stud along an interior surface of the support. Included is a cylindrical member. The cylindrical member has a pair of side surfaces and a cylinder surface therebetween. The cylinder surface has a plurality of cylindrical projections proportionately spaced thereon. The cylindrical member further has a pair of ratchet members. One ratchet member is integral the cylindrical member and projects from one of the side surfaces. Another ratchet member is integral the cylindrical member and projects from another of the side surfaces. Also, an axial rod is provided. The rod is positionable through the brackets, the forked ends and the cylindrical member axially for rotational engagement with the cylindrical member positionable between the forked end of the handle. The forked end of the handle has two legs with each leg having a pawl positioned along an inner area of each leg and attached to each leg with a rivet. Each pawl is capable of engaging a respective ratchet member of the cylindrical member when the handle is moved. Movement of the handle causes movement of ratchet member in a single direction. Lastly, banding material is included. The banding material has a plurality of holes therethrough and is weaved around a plurality of bowed studs aligned in a series. The banding material is secured by a nail to one of the bowed studs. The banding material is capable of being threaded around the cylindrical member when the adjuster is positioned on a stud opposite, and spaced from the stud securing the banding material. The holes of the banding material are capable of being engaged by the cylindrical projections of the cylindrical member when the handle is moved. The handle engages the ratchets which causes the rotation of the cylindrical member. The cylindrical member when rotated pulls the banding material in a direction to cause the bowed studs to be straightened and brought flush.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved star stud adjuster apparatus which has all of the advantages of the prior art stud positioning devices and none of the disadvantages.

It is another object of the present invention to provide a new and improved star stud adjuster apparatus which may be easily and efficiently manufactured and marketed.

It is further object of the present invention to provide a new and improved star stud adjuster apparatus which is of durable and reliable constructions.

An even further object of the present invention is to provide a new and improved star stud adjuster apparatus which is susceptible of a low cost of manufacture with regard to both materials and labor, and which accordingly is then susceptible of low prices of sale to the consuming public, thereby making such star stud adjuster apparatus economically available to the buying public.

Still yet another object of the present invention is to provide a new and improved star stud adjuster apparatus which provides in the apparatuses and methods of the prior art some of the advantages thereof, while simultaneously overcoming some of the disadvantages normally associated therewith.

Even still another object of the present invention is to provide a star stud adjuster apparatus for to straightening bowed studs and using,the apparatus to make them flush.

Lastly, it is an object of the present invention to provide a new and improved stud adjuster apparatus including an adjuster. The adjuster includes a J-shaped support with an exterior surface that has a pair of brackets projecting therefrom. Additionally, the support has a handle with a forked end capable of being positioned between the brackets. Included is a cylindrical member. The cylindrical member has a pair of side surfaces with each having a ratchet integral thereto and projecting therefrom. The cylindrical member is positionable between the forked ends and held in place with an axial rod. Lastly, banding material is provided. The banding material is weaved around a plurality of bowed studs and is secured by a nail to one of the bowed studs. The banding material is capable of being positioned around the cylindrical member between the forked end when the adjuster is positioned on an opposite stud.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
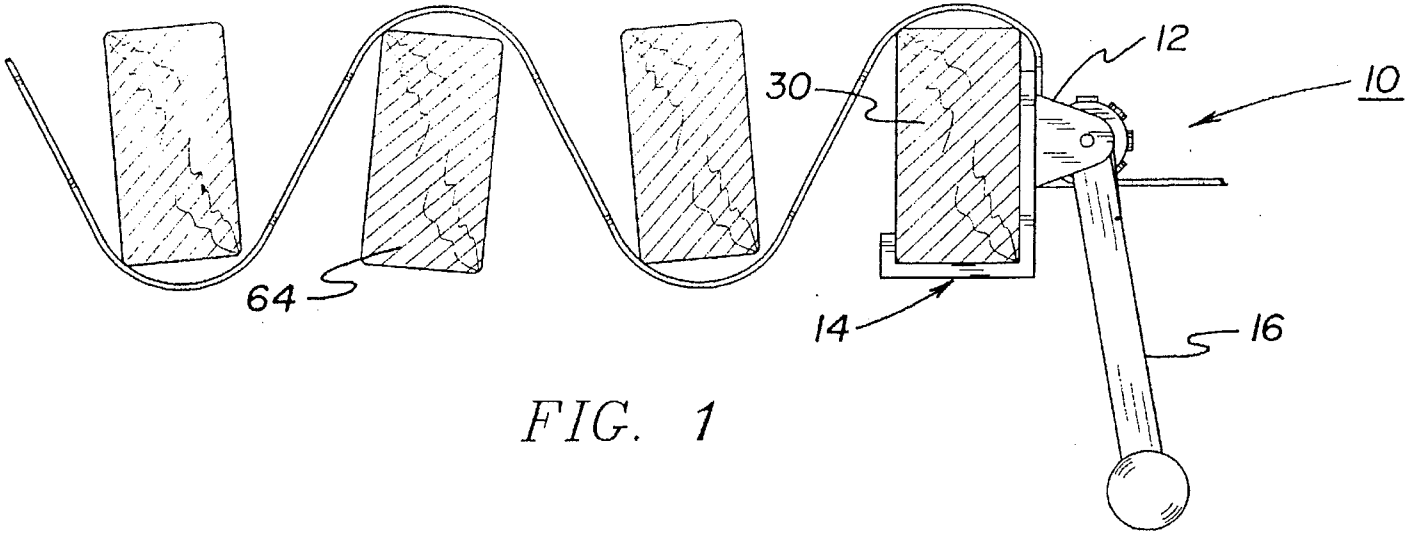
FIG. 1 is a perspective view of the preferred embodiment of the stud adjuster apparatus constructed in accordance with the principles of the present invention.

With reference now to the drawings, and in particular to FIG. 1 thereof, the preferred embodiment of the new and improved star stud adjuster apparatus embodying the principles and concepts of the present invention and generally designated by the reference numeral 10 will be described.

The present invention, the star stud adjuster apparatus 10 is comprised of a plurality of components. Such components in their broadest context include an adjuster and banding material. Such components are individually configured and correlated with respect to each other so as to attain the desired objective.

Specifically, the present invention includes an adjuster 12 as shown in FIG. 1. The adjuster is formed of a rigid material. The adjuster includes a J-shaped support 14 and a handle 16 with a forked end 18. The J-shaped support has a long arm 22, a short arm 24 and an arm connector 26 therebetween. The long arm has a length of about 4 to 4½ inches and an exterior surface with a pair of brackets 28 projecting therefrom. The brackets are capable of coupling with the forked end of the handle. The support is further capable of being positioned around a generally rectangular stud 30 along an interior surface 32 of the support.

Figure 3:
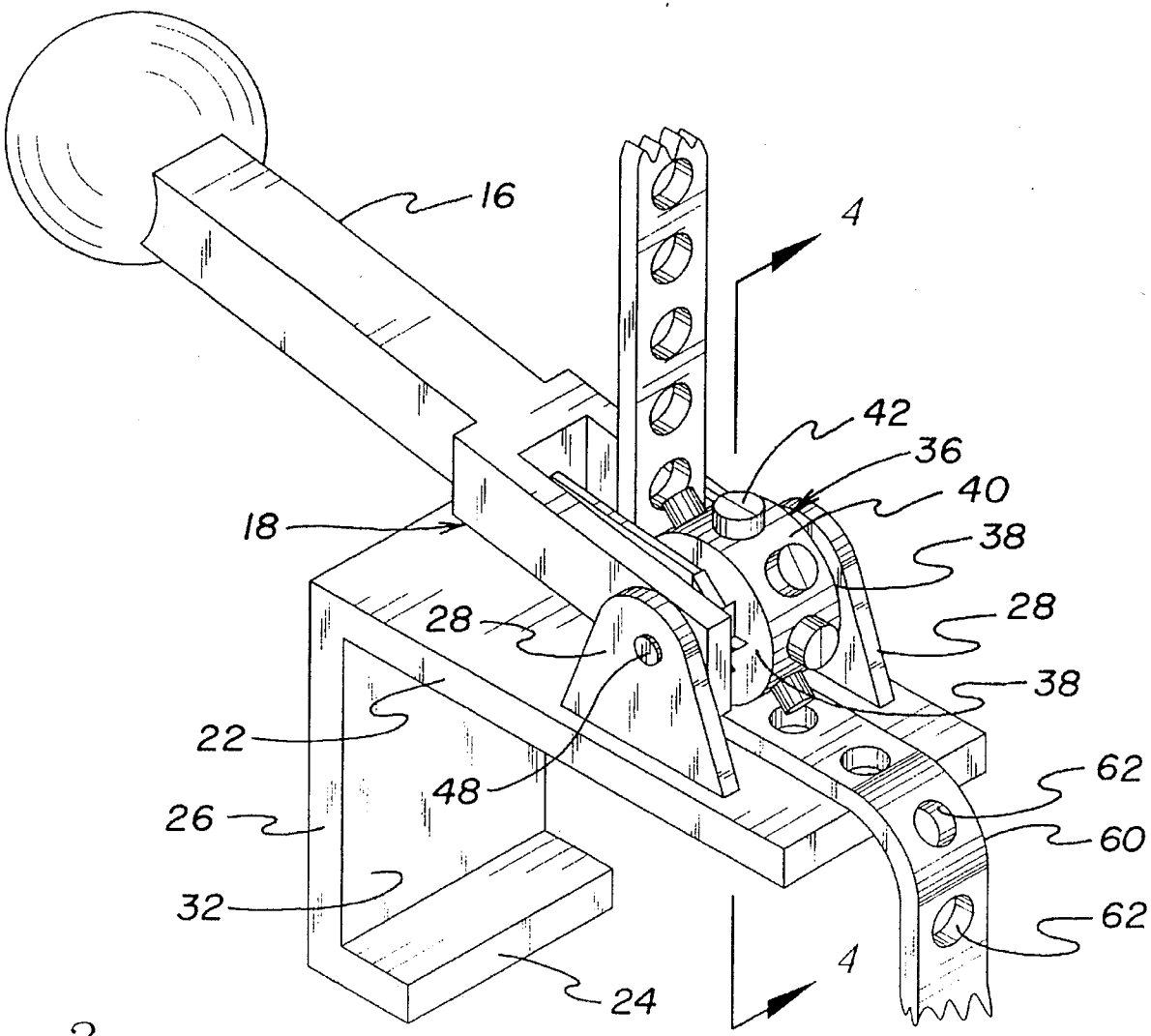
FIG. 3 is a elevated view of the present invention in an operable configuration.
Figure 4:
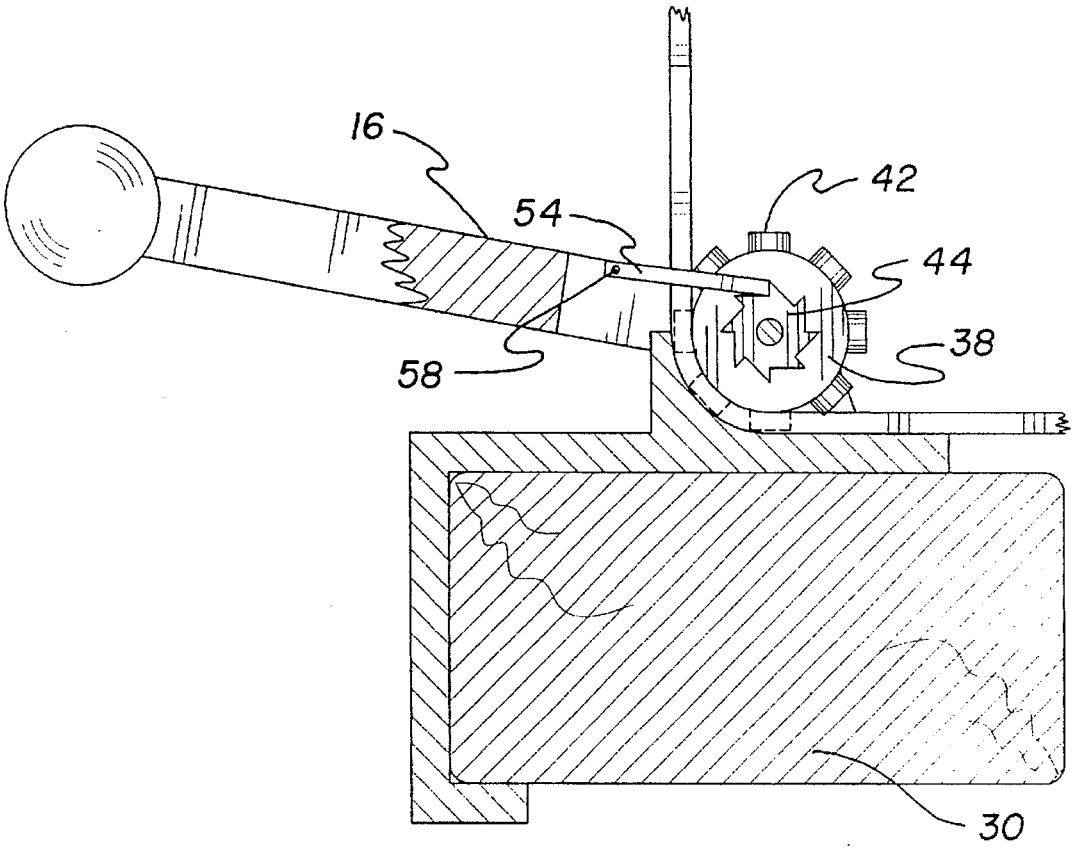
FIG. 4 is a section view of the present invention taken along the line 4—4 of FIG. 3.

As best illustrated in FIG. 3, a cylindrical member 36 is included. The cylindrical member is formed of a rigid material. The cylindrical member has a pair of side surfaces 38 and a cylinder surface 40 therebetween. The cylinder surface, as shown in FIG. 4, has a plurality of cylindrical projections 42 evenly spaced therearound. The cylindrical member further has a pair of ratchet members 44. One ratchet member is integral the cylindrical member and projects from one of the side surfaces. Another ratchet member is integral the cylindrical member and projects from another of the side surfaces. Each ratchet member encompasses a portion of the side surface of the cylindrical member.

Figure 5:
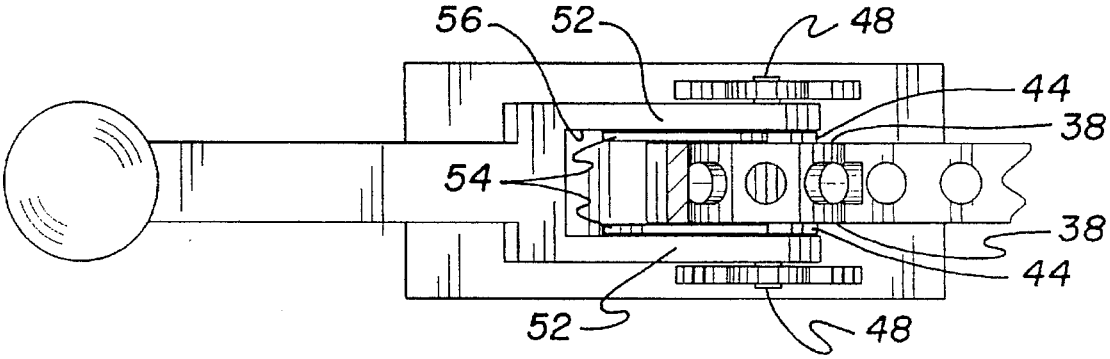
FIG. 5 is plan view of the star stud adjuster in an operable configuration.

Also included is an axial rod 48 as shown in FIG. 5. The rod is positionable through the brackets 28, the forked end 18 and the cylindrical member 36 axially for rotational engagement. The cylindrical member is positioned between the forked end of the handle when the rod is positioned therethrough.

The forked end of the handle has two legs 52. Each leg has a pawl 54 positioned along an inner area 56 thereof. The pawl of each leg is attached to each leg with a rivet 58. Each pawl being capable of engaging a respective ratchet member, as shown in FIG. 4. The engagement of the ratchet of the cylindrical member, by the pawl, occurs when the handle is moved for movement of the ratchet member in a single direction.

Figure 2:
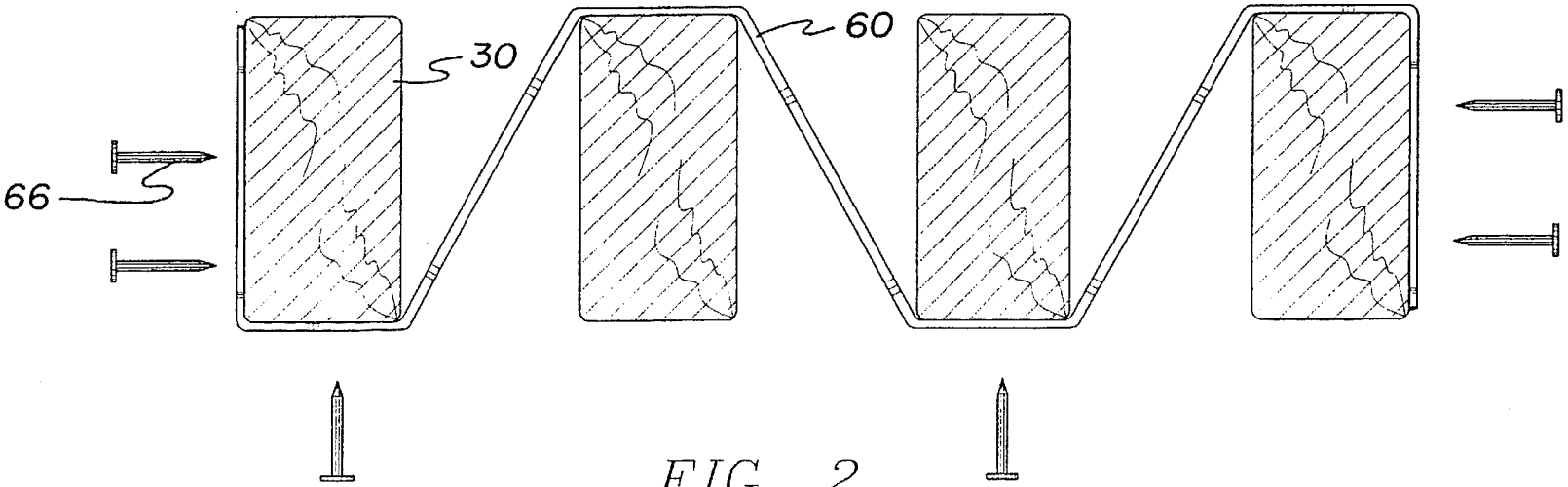
FIG. 2 is a perspective view of the studs after use of the invention of FIG. 1.

Lastly, banding material 60 is provided. The banding material as shown in FIG. 3, has a plurality of holes 62 therethrough. Additionally the banding material is weaved around a plurality of bowed studs 64 aligned in a series, as illustrated in FIGS. 1. The banding material is secured by a nail 66 to one of the bowed studs. The banding material is capable of being threaded around the cylindrical member 36 when the adjuster is positioned on a stud opposite and spaced from the stud securing the banding material. As best illustrated in FIG. 4, the holes of the banding material are capable of being engaged by the cylindrical projections 42 of the cylindrical member. When the handle is moved the pawl 54 engages the ratchet 44 which causes the rotation of the cylindrical member. The cylindrical member is rotated and pulls the banding material in a direction to cause the bowed studs to be straightened and brought flush. FIG. 2 shows the bowed studs after straightening with the adjuster.

The present invention provides an easy use apparatus for straightening studs in homes for the wall board without the need for replacing bowed studs. The adjuster is made from a rigid material able to with stand the torque of pulling the banding material. The adjuster pulls the banding material that has been weaved around the bowed studs. The handle of the adjuster is rotated in a first direction to cause the pawls to engage the ratchet of the cylindrical member. The movement of the cylindrical member engages the holes of the banding member and slowly pulls the band tight around the bowed studs. The handle is then allowed to remain in an engaged position with the ratchet member to hold its place once the band straightens the studs. The present invention saves the builder the cost of replacing 80% to 90% of the bowed studs in home construction.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A stud adjuster apparatus comprising in combination:

an adjuster including a J-shaped support and a handle with a forked end, the J-shaped support having a long arm, a short arm and an arm connector therebetween, the long arm having an exterior surface with a pair of brackets projecting therefrom, the brackets being coupled with the forked end of the handle, the support being positionable around a generally rectangular stud along an interior surface of the support;

a cylindrical member having a pair of side surfaces and a cylinder surface therebetween, the cylinder surface having a plurality of cylindrical projections spaced evenly therearound, the cylindrical member further having a pair of ratchet members, one of said ratchet members being integral thereto and projecting from one of the side surfaces, and the other of said ratchet members being integral thereto and projecting from another of the side surfaces;

an axial rod positioned through the brackets, the forked end, and the cylindrical member, to rotationally mount the cylindrical member and the forked end of the handle on the brackets;

the forked end of the handle having two legs, each leg having a pawl positioned along an inner area of the leg and attached to the leg with a rivet, each pawl being capable of engaging a respective ratchet member of the cylindrical member when the handle is moved, to cause movement of the ratchet member in a single direction; and banding material having a plurality of holes therethrough being weaved around a plurality of bowed studs aligned in a series, the banding material being secured by a nail to one of the bowed studs, the banding material being threaded around the cylindrical member when the adjuster is positioned on a stud opposite and spaced from the stud securing the banding material, the holes of the banding material being engaged by the cylindrical projections of the cylindrical member when the handle is moved, wherein the movement of the cylindrical member pulls the bending material in a direction to cause the bowed studs to be straightened and brought flush with each other.

2. A stud adjuster apparatus comprising:

an adjuster including a J-shaped support with an exterior surface having a pair of brackets projecting therefrom and a handle with a forked end being positioned between the brackets;

a cylindrical member having a pair of side surfaces, each of the pair of side surfaces having a ratchet integral thereto and projecting therefrom, the cylindrical member being positionable between two legs of the forked end;

at least one pawl mounted on the handle for engagement with one of the ratchets to rotate the cylindrical member;

an axial rod being positioned through the brackets for holding the cylindrical member between the forked ends of the handle; and banding material being weaved around a plurality of bowed studs and being secured by a nail to one of the bowed studs, the banding material being positioned around the cylindrical member between the legs of the forked end when the adjuster is positioned on an opposite stud.

3. The stud adjuster apparatus as set forth in claim 2 wherein the J-shaped support has a long arm with the brackets projecting therefrom, a short arm and an arm connector therebetween, and being hookingly positioned around a stud.

4. The stud adjuster apparatus as set forth in claim 3 wherein the long arm has a length of between 4 to 4½ inches with the arm connector being about 2½ inches.

5. The stud adjuster apparatus as set forth in claim 2 wherein the cylindrical member has a cylindrical surface with a plurality of cylindrical projections spaced evenly therearound.

6. The stud adjuster apparatus as set forth in claim 5 wherein the banding material has a plurality of holes therethrough capable of being engaged by the cylindrical projections when the banding material is threaded around the cylindrical member.

7. The stud adjuster apparatus as set forth in claim 2 wherein legs of the forked end each have an inner area with a pawl positioned thereon, and the pawl of each leg engaging the ratchet of each side surface of the cylindrical member for movement of the cylindrical member.

* * * * *